United States Patent [19]

Frei

[11] Patent Number: 4,913,016

[45] Date of Patent: Apr. 3, 1990

[54] WASTE STRIPPING TOOL FOR USE IN A MACHINE USED FOR CUTTING SHEET-LIKE ITEMS

[75] Inventor: Peter Frei, Sullens, Switzerland

[73] Assignee: Bobst SA, Switzerland

[21] Appl. No.: 300,093

[22] Filed: Jan. 19, 1989

[30] Foreign Application Priority Data

Jan. 20, 1988 [CH] Switzerland ..... 00192/88

[51] Int. Cl.[4] ..... B26D 7/18

[52] U.S. Cl. ..... 83/103; 83/700; 225/97; 403/393

[58] Field of Search ..... 83/103, 699, 700; 225/97; 403/104, 110, 393, 387

[56] References Cited

U.S. PATENT DOCUMENTS

| | | | |
|---|---|---|---|
| 341,204 | 5/1886 | Adler | 83/700 |
| 1,538,595 | 5/1925 | Schroeder | 403/393 |
| 2,110,998 | 3/1938 | McDaniels | 83/103 |
| 2,685,876 | 8/1954 | Sanderson | 403/104 |
| 3,079,186 | 2/1963 | Williams | 403/393 |
| 3,386,398 | 6/1968 | Cobble, Sr. et al. | 83/700 |
| 3,717,290 | 2/1973 | Bentley et al. | 225/97 |
| 4,252,456 | 2/1981 | Kallaes et al. | 403/393 |
| 4,617,775 | 10/1986 | Padrum | 403/393 |

*Primary Examiner*—Frank T. Yost
*Assistant Examiner*—Scott A. Smith
*Attorney, Agent, or Firm*—Hill, Van Santen, Steadman & Simpson

[57] ABSTRACT

A waste stripping tool comprising a grid formed of crossbar members consisting of a crossbar assembly of two members held side-by-side by a coupler. The assembly consists of a strap, which has two jaws having two triangular profiled teeth engaged in grooves in each of the crossbar members and threaded arrangement for causing a clamping of the jaws onto the members to hold them in a side-by-side relationship. The assembly can be utilized in a stripping station of a sheet die cutting machine and allows for the reduction of the number of bars needed to construct the frame of different sizes for the particular station.

6 Claims, 3 Drawing Sheets

WASTE STRIPPING TOOL FOR USE IN A MACHINE USED FOR CUTTING SHEET-LIKE ITEMS

BACKGROUND OF THE INVENTION

The present invention is directed to a waste stripping tool which consists of a plain frame holding crossbars on which stripping equipments are secured. The tool is fitted in a machine for cutting sheets like items, such as, for instance, papers sheets or boards sheets.

A machine for cutting paper sheets or paper board sheets usually comprises successive stages, such as an infeed station in which the sheets are picked up one-by-one from a pile, a feeder table on which the sheet is aligned along its front and lateral edges before being seized by grippers which are on a continuous conveyor for the die cutting device. The grippers of the die cutting device carry the sheet through a cutting station, such as a platen press, having cutting and creasing tools, then to a stripping station in which waste portions of the die cut sheet are removed and, finally, to a delivery station where the cut sheets are collected.

Immediately after cutting, the sheet is carried into the flat-bed stripping station on a horizontal stripping plate provided with apertures which are aligned with the parts of the sheet which are to be stripped therefrom. Positioned above the horizontal stripping plate is a horizontal upper stripping tool holding device on which stripping pins or strippers and/or pressing items are mounted for movement in a vertical direction. Beneath the horizontal stripping plate, a second horizontal fixed stripping tool is arranged and holds a plurality of vertical telescopic pins which are aligned with the upper stripping pins for engaging portions extending into the apertures in the stripping plate.

The ends of these telescopic pins penetrate into the apertures of the stripping plate and reach a level which is slightly below the upper plane of the plate. Consequently, when the upper tool is lowered onto the cut strip, which is appropriately positioned, the coaction between the upper stripping elements and the telescopic pins will pinch the piece of paper or board which are to be stripped from the cut sheet in order to carry them down through the apertures in the stripping plate before dropping them into a basin or bin.

These stripping tools are repositioned with every change of the production run with a view to their being adapted to the new requirements, such as to type of sheet, size of the sheets, and the configuration of the parts to be stripped. Especially, the lower tools have to be constructed in such a way that its structure will not interfere with the free fall of the waste bits after their removal by the stripping tools.

To accomplish this, the tools ordinarily consist of a rectangular frame within which is fitted a grid of transverse members made of profile metal bars, preferably of aluminum. The bar's profile has a height that is greater than its width to insure a high rigidity in the vertical direction for the tool. The stripping equipment proper are then arranged, as required, along these transverse members and held in place by anchoring pieces or parts. In order to enable the user to create his own stripping tool for any configuration of paper sheets or board that are to be processed, these machines are supplied with an ample set of traverse members, i.e. an average of 40 pieces or members.

In practical use, the grid-shaped arrangement of crossbars or members changes in size due to the changes in size of the sheets of material being processed. This is particularly true with the lower tool frame which, for obtaining an easy stripping of the large-sized rear crosswise waste portion, should have no cross member after the one situated at the level for the knives separating the rear waste from the sheet. Thus, it has happened that the operators, in order to obtain shorter cross members or frame members to form a desired reduced size frame, cut several of the members to reduce their length. Due to this cutting, when longer members are necessary, new cross members must be purchased.

SUMMARY OF THE INVENTION

The object of the present invention is to provide a stripping tool which can be easily dimensioned, as required by the size of the sheets to be processed, and ensures that the same rate of rigidity is present while involving a lesser investment for materials.

These objects are achieved in an improvement in a waste stripping tool in a machine designed for cutting sheet-like items, said stripping tool comprising a frame within which are attached, to extend orthogonally between the ends of the frame, transverse or crossbar members on which stripping elements are secured. The improvement comprises that at least two of the transverse or crossbar members are linked together side-by-side in a lengthwise direction in such a way to form a crossbar assembly whose length can be adjusted to correspond to the distance separating the two ends or sides of the frame between which this assembly is secured.

Preferably, two of the transverse or crossbar members are linked together by means of a coupling which is situated approximately in the middle between the overlapping areas and two clamping bars, one fitted at the free end of each of the transverse members and engaging in the lateral groove of the other transverse members are present.

For appropriate use, the coupling comprises a rectangular strap having a lower jaw directed upwardly and fitted on an inner face of the lower side of the strap and an upper movable jaw directed downward and guided by a pin sliding within an opening drilled in an intermediate plate which is arranged against the inner face of the upper side and a threaded member passing through the upper side and threaded into a vertical hole situated in the center of the intermediate plate so that the threaded member has the purpose of urging the upper jaw against the transverse members.

On their faces entering into contact with the upper and lower faces of the transverse members, these jaws are advantageous provided with two teeth that extend side-by-side and have a triangular transverse cross section which will engage in grooves which have a corresponding triangular cross section which are provided in the upper and lower surfaces of each of the transverse members.

Other advantages and features of the invention will be readily apparent from the following description of the preferred embodiment, the drawings and claims.

DESCRIPTION OF THE PREFERRED EMBODIMENTS

Figure 1:
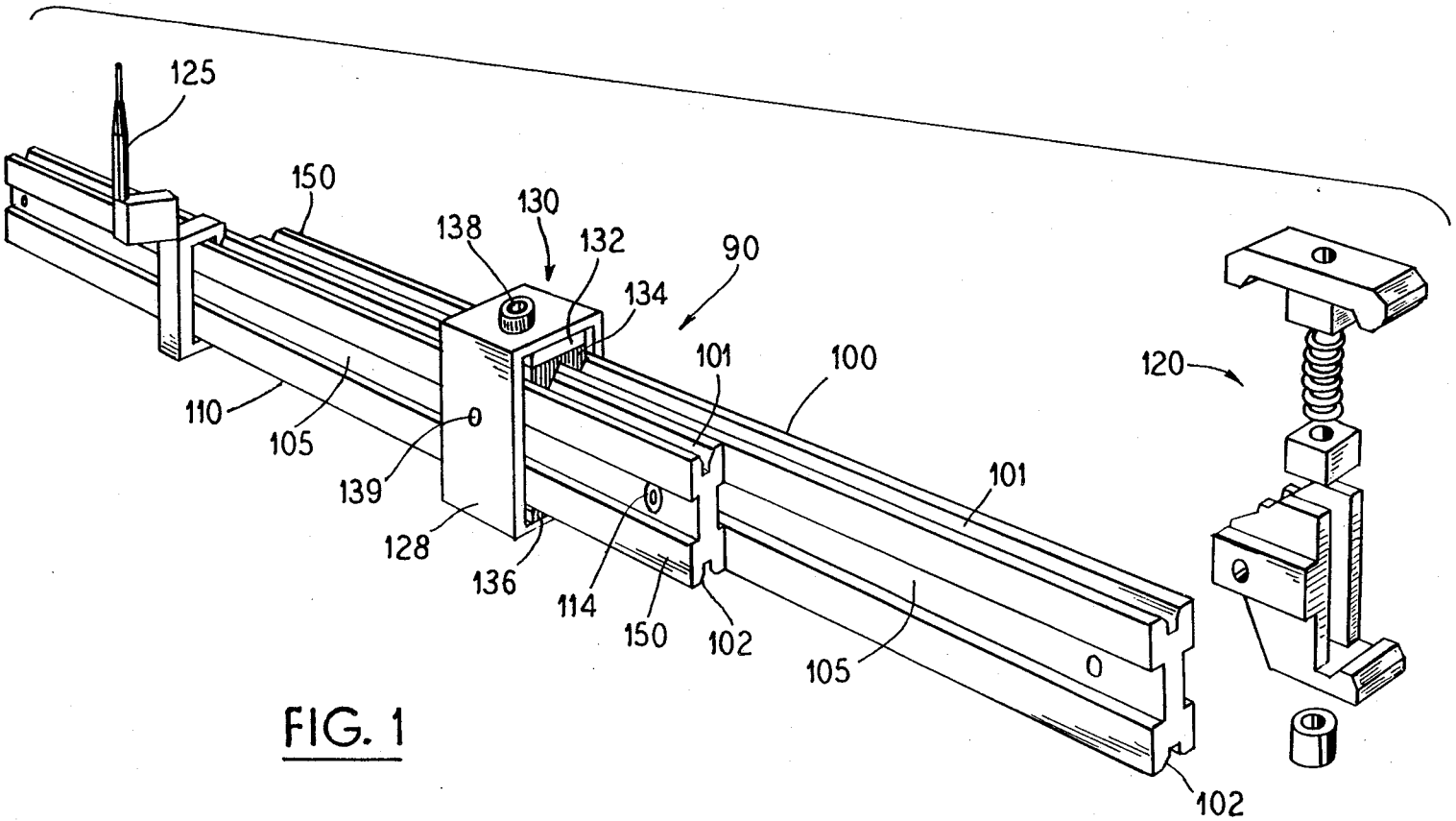
FIG. 1 is a perspective view of the adjustable transverse interconnected members of the present invention.
Figure 2:
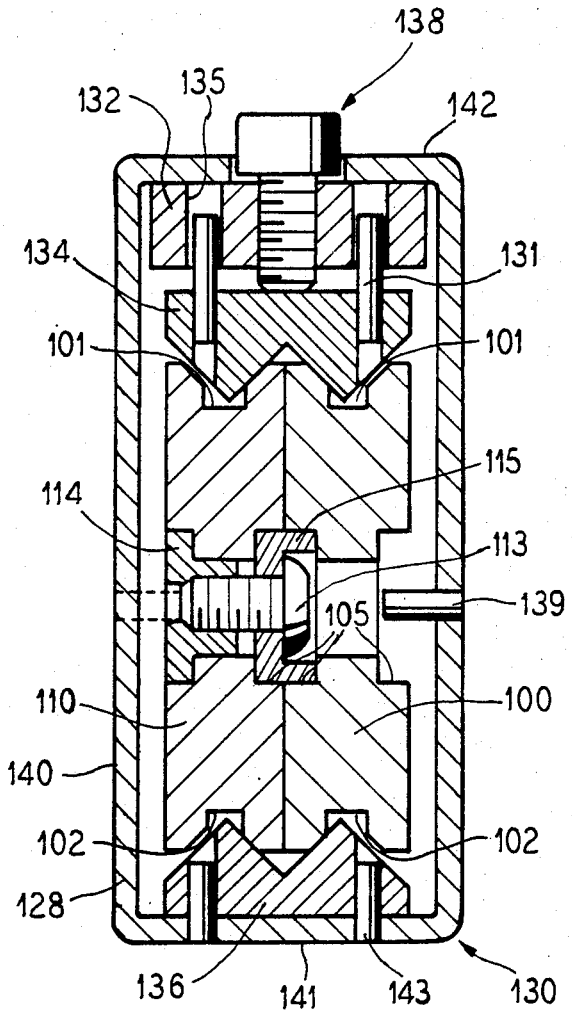
FIG. 2 is a transverse cross sectional view of the arrangement of FIG. 2, with portions in elevation for purposes of illustration.

The principles of the present invention are particularly useful when incorporated into an adjustable transverse or crossbar assembly, generally indicated at 90 in FIGS. 1 and 2. The adjustable transverse assembly is composed of two bars or members 100 and 110, which have a rectangular cross section and are provided with a top groove 101, a bottom groove 102, and a groove 105 on each of the two sides. The two bar-shaped members 100 and 110 are adjustably held together by a coupling, generally indicated at 130. The assembly 90 is anchored on a frame member 70 of a tool frame 60 (FIGS. 3 and 4) or on another transverse member 90*a* by a fixture, generally indicated at 120 which is attached to each end of the assembly 90 and forms means for securing the assemblies to a frame member 70 or member 90*a*. Thus, a grid of these adjustable transverse or crossbar assemblies can be provided in the appropriate arrangement and shape. Stripping elements, for instance a telescopic pin 125 (FIG. 1), can be secured at a desired position on any one of the adjustable transverse assemblies, as required by the particular stripping operation.

The coupling 130 holds the two bar members 100 and 110 in a side-by-side relationship in that portion which is overlapping. The coupling has a rectangular, box-shaped member or strap 128 which has a pair of sides 140 extending between a lower end 141 and an upper end 142 (see FIG. 2). On the lower end or part 141, an upwardly directed jaw 136 is fitted by means of pins 143. Instead of using pins to secure the jaw 136 on the lower end 141, screws or threaded fasteners, or even a weld, can be utilized. The upper part or end 142 supports an intermediate plate 132 which has one or more holes 135 within which pins 131 secured in an upper jaw 134 slide.

As best illustrated in FIG. 2, each of the jaws 134 and 136 has two parallel extending, side-by-side teeth which have a triangular cross section profile. As illustrated, the teeth of the jaw 136 extend into the lower grooves 102 of the bar members 100 and 110. As illustrated, the lower grooves 102 are provided with bevels or chamfers, as are the upper grooves 101, so that the triangular teeth of the upper and lower jaws easily move into these grooves and when the jaws are pressed together will press the bars 100 and 110 firmly against one another.

In order to move the upper jaw 134 towards the lower jaw 136, a threaded member 138 is threaded through a threaded bore in the intermediate member or plate 132 and has its end engaging a back surface of the jaw 134. Thus, when the threaded member 138 is turned in one direction, it urges the jaw 134 towards the lower jaw 136 and the pins 131 guide the movable jaw.

The sides 140 of the rectangular strap or box 128 have lateral pins, such as 139, which insure the centering of the coupling with regard to the two bars 100 and 110.

At the free end or overlapping end 150 of each of the bars 100 and 110, a clamping bar 115, which is provided with a threaded fastener or screw 113, is slipped into one of the side grooves 105 and has its screw 113 received in a counter-nut 114 disposed in the opposite groove 105. The clamping bar 115 has a depth so that it will extend from the groove of its bar, such as the bar 110 into the groove 105 of the adjacent bar or member 100.

For linking the two bars or members 100 and 110 together, the operator previously fastens the clamping bars 115 on the free end 150 of each of the members, which are then assembled lengthwise in such a way that the clamping bars 115 engage in the lateral grooves 105 of the other member and assure that a vertical rigidity of the assembly will occur. At this stage, the coupling 130 is assembled on the two bars 100 and 110 in that region where there is an overlap therebetween and the teeth of the upper and lower jaws are received in the corresponding grooves of the members 110 and 100. In this way, the coupling can be moved easily along two members in order to shift it to a central point of the overlapping area of the two members. Then, using a screwdriver or any other appropriate tool, as required by the type of nuts used, the operator can turn the threaded fastener 138 to move into the plate 132 to urge the plate away from the jaw 134. As soon as the plate 132 engages the inner wall of the upper end or portion 142 of the strap, a further threading of the screw will push the upper jaw 134 toward the lower jaw to grip the two members 100 and 110 between the upper and lower jaws.

Figure 3:
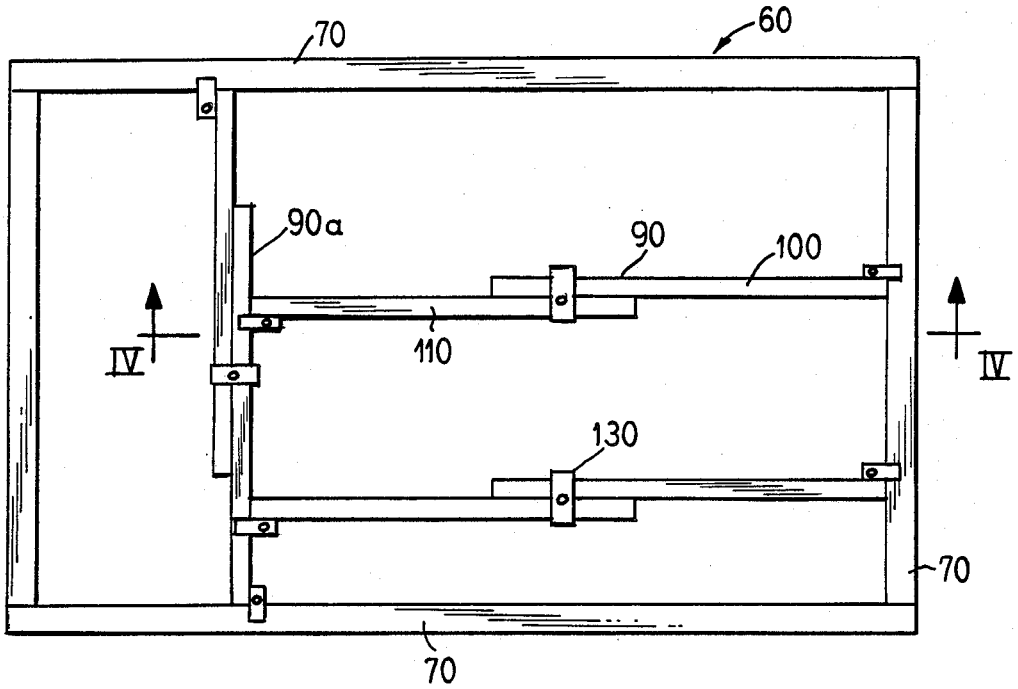
FIG. 3 is a plan view of a frame containing an arrangement of the interconnected members.
Figure 4:
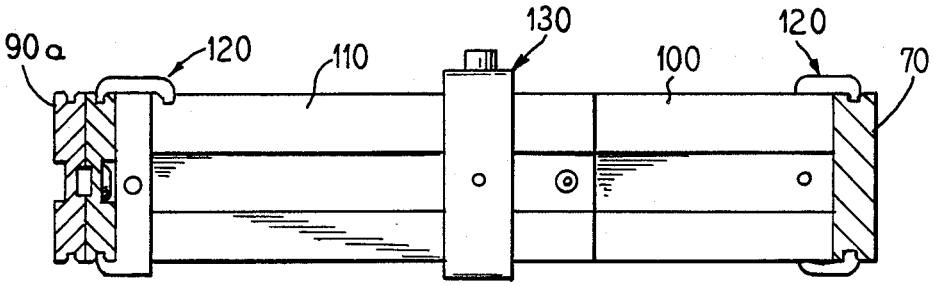
FIG. 4 is a view taken on line IV—IV of FIG. 3.

In this way, due to this device, the two members 100 and 110 are interlocked, both lengthwise and crosswise by the two jaws of the coupling 130 and with the two clamping bars 115 engaged in the grooves 105 of the corresponding member provide a rigid structure for the assembly 90. As illustrated in FIG. 3, the tool frame 60 with frame members 70 is a rectangular frame and has a transverse adjustable member 90*a* extending between two frame members 70. The crossbar assemblies 90 have their length adjusted to the spacing between the frame member 70 and the member or assembly 90*a* and are then mounted thereon to from a grid to support the pins 125 in the desired positions beneath the stripper plate.

It is noted that the coupling can be positioned to allow a large range of lengths for the assembly 90, as desired by the operator of the stripping device.

Although various minor modifications may be suggested by those versed in the art, it should be understood that I wish to embody within the scope of the patent granted hereon all such modifications as reasonably and properly come within the scope of my contribution to the art.

I claim:

1. In a waste stripping tool used in a machine designed for cutting sheet material, said stripping tool including a frame within which are fitted crossbars to extend orthogonally between two opposite frame members of said frame, said crossbars having stripping elements mounted thereon, the improvement comprising each crossbar being an adjustable crossbar assembly having two ends and including two crossbar members being linked together lengthwise side-by-side in such a way that the length of the crossbar assembly corresponds to the distance separating the two opposite frame members between which it is secured, said assembly at each end having means for securing the assembly to said frame members.

2. In a waste stripping tool according to claim 1, wherein the two crossbar members of the crossbar assembly are linked together by means of a coupling situated approximately in the middle between overlapping areas of the two crossbar members and each crossbar member having a clamping bar fitted on a free end of the crossbar member and being engaged in a lateral groove in the adjacent crossbar member.

3. In a stripping tool according to claim 2, wherein the coupling comprises a rectangular strap having an upper end, lower end and two side walls, a lower jaw having teeth being mounted on the inner face of the lower end of the strap with the teeth directed upwardly, an upper movable jaw having teeth directed downward and guided by pins sliding within apertures in an intermediate plate, which is mounted passing through the upper end of the strap and threaded into a tapped vertical hole in the center of the intermediate plate, said screw pushing the upper jaw against the crossbar members.

4. In a stripping tool according to claim 3, wherein each of the upper and lower jaws have two teeth extending parallel and side-by-side, said teeth each having a triangular configuration and each of the crossbar members having a groove in the upper and lower ends engageable by said teeth.

5. In a waste stripping tool used in a machine designed for cutting sheet material, said stripping tool including a frame within which are fitted crossbars to extend orthogonally between two opposite frame members of the frame, said crossbars having stripping elements mounted thereon, the improvement comprising an adjustable crossbar assembly including two crossbar members linked together lengthwise side-by-side by means of a coupling situated approximately in the middle between overlapping areas of the two crossbar members so that the length of the crossbar assembly corresponds to the distance separating the two opposite frame members between which the assembly is secured, each crossbar member having a clamping bar fitted on a free end of the crossbar member and being engaged in a lateral groove in the adjacent crossbar member, the coupling comprising a rectangular strip having an upper end, lower end and two side walls, a lower jaw having teeth being mounted on an inner face of the lower end of the strap with the teeth directed upwardly, an upper movable jaw having teeth directed downward and guided by pins sliding within apertures in an intermediate plate, which is mounted adjacent an inner surface of the upper end, a threaded member passing through the upper end of the strap and threaded into a tapped vertical hole in the center of the intermediate plate, said screw pushing the upper jaw against the crossbar members.

6. In a stripping tool according to claim 5, wherein each of the upper and lower jaws have two teeth extending parallel and side-by-side, said teeth each having a triangular configuration and each of the crossbar members having a groove in the upper and lower ends engageable by said teeth.

* * * * *